US012371130B2

(12) United States Patent
Heyring et al.

(10) Patent No.: US 12,371,130 B2
(45) Date of Patent: Jul. 29, 2025

(54) STRUCTURE FOR MARINE VESSEL

(71) Applicant: NAUTI-CRAFT LTD, Dunsborough (AU)

(72) Inventors: Christopher Brian Heyring, Eagle Bay (AU); Michael James Longman, Dunsborough (AU)

(73) Assignee: NAUTI-CRAFT LTD, Dunsborough (AU)

( * ) Notice: Subject to any disclaimer, the term of this patent is extended or adjusted under 35 U.S.C. 154(b) by 644 days.

(21) Appl. No.: 17/767,095

(22) PCT Filed: Oct. 8, 2020

(86) PCT No.: PCT/AU2020/051085
§ 371 (c)(1),
(2) Date: Apr. 7, 2022

(87) PCT Pub. No.: WO2021/068035
PCT Pub. Date: Apr. 15, 2021

(65) Prior Publication Data

US 2022/0363342 A1 Nov. 17, 2022

(30) Foreign Application Priority Data

Oct. 8, 2019 (AU) ..... 2019903791

(51) Int. Cl.
*B63B 1/14* (2006.01)
*B63B 3/14* (2006.01)
*B63B 39/00* (2006.01)

(52) U.S. Cl.
CPC ..... *B63B 1/14* (2013.01); *B63B 39/00* (2013.01); *B63B 2001/145* (2013.01); *B63B 2003/145* (2013.01)

(58) Field of Classification Search
CPC ..... B63B 1/14; B63B 39/00; B63B 2001/145; B63B 2003/145
See application file for complete search history.

(56) References Cited

U.S. PATENT DOCUMENTS 2,584,122 A * 2/1952 Gilmore ..... B60G 17/02 180/41
6,176,190 B1 1/2001 Ozga
(Continued)

FOREIGN PATENT DOCUMENTS

FR 2450192 9/1980

*Primary Examiner* — Anthony D Wiest
(74) *Attorney, Agent, or Firm* — Allen, Dyer, Doppelt + Gilchrist, PA

(57) ABSTRACT

A chassis module for a vessel, the chassis module having: a frame; a left linkage arrangement including at least one left hull connection and configured to movably couple the frame to at least one left hull when the left hull connection is connected to the left hull; a right linkage arrangement including at least one right hull connection and configured to movably couple the frame to at least one right hull when the right hull connection is connected to the right hull; at least one left support mount and at least one right support mount for respectively connecting to a respective support providing support for the frame relative to the respective left or right hull when hulls are connected to the hull connections; the frame having a plurality of body attachments to facilitate attachment of the chassis module to a body of a vessel.

22 Claims, 6 Drawing Sheets

(56) References Cited

U.S. PATENT DOCUMENTS

| | | | |
|---|---|---|---|
| 2006/0144311 | A1 | 7/2006 | Heyring et al. |
| 2009/0227159 | A1 | 9/2009 | Meyer |
| 2013/0213288 | A1 | 8/2013 | Hall |
| 2019/0092435 | A1 | 3/2019 | Longman et al. |
| 2021/0188399 | A1* | 6/2021 | Longman ..... B63B 1/14 |

* cited by examiner

STRUCTURE FOR MARINE VESSEL

TECHNICAL FIELD

The present invention relates to marine vessels and in particular to structures suitable for application to marine vessels having multiple hulls movable relative to a body.

BACKGROUND

While most marine vessels have one or more hulls fixed relative to a superstructure, there are known vessels which allow the hulls to move relative to the body or superstructure. However, the addition of hull locating linkages, resilient supports and consideration of the loads involved in the supports and locating linkages are difficult for most boat builders since they typically do not have the relevant expertise.

SUMMARY OF INVENTION

Disclosed is a chassis module for a vessel, the chassis module having: a frame; a left linkage arrangement including at least one left hull connection, the left linkage arrangement configured to movably couple the frame to at least one left hull when the at least one left hull connection is connected to the at least one left hull; a right linkage arrangement including at least one right hull connection, the right linkage arrangement configured to movably couple the frame to at least one right hull when the at least one right hull connection is connected to the at least one right hull; at least one left support mount for connecting to at least one left support that provides support for the frame relative to the at least one left hull when the at least one left hull connection is connected to the at least one left hull; at least one right support mount for connecting to at least one right support that provides support for the frame relative to the at least one right hull when the at least one right hull connection is connected to the at least one right hull; the frame having a plurality of body attachments arranged to facilitate attachment of the chassis module to a body of a vessel.

In accordance with a first aspect of the present invention, there is provided a chassis module for a vessel, the chassis module comprising a frame, at least one left locating linkage arrangement for at least one left hull and at least one right locating linkage arrangement for at least one right hull; each locating linkage arrangement permitting at least heave motions of the respective hull relative to the frame and constraining the respective hull in at least lateral, longitudinal, roll and yaw directions relative to the frame, when the respective hull is connected to the respective locating linkage arrangement; each locating linkage arrangement including at least one member, the or each member having at least one respective movable first joint adjacent a first end and having at least one respective movable second joint adjacent a second end, each movable second joint being connected directly or indirectly to the respective hull when the respective hull is connected to the respective locating linkage arrangement; the frame including respective locating linkage frame mounts or attachment points for at least one of the movable first joints of each locating linkage arrangement; the frame including respective support frame mounts for at least one left support and at least one right support; and the frame including mounts or attachment points for a body of the vessel.

One or more of the members may be a rod, so may be elongate, extending at least between the first joint and the second joint. One or more of the members may be a wishbone, so may for example have a second joint adjacent its outer end and have two first joints spaced at least longitudinally apart, adjacent its inner end when viewed from front view.

One or more of the second joints may connect directly to a respective mount fixed to or part of the respective hull when the respective locating linkage arrangement is connected to the respective hull, i.e. the mount may be part of the structure of the respective hull and more than one mount may be provided, with typically at least two mounts being provided and longitudinally spaced on the respective hull. Alternatively, one or more of the hull joints may connect to a respective mount on a mount bracket, the mount bracket being fixed to the respective hull when the respective locating linkage arrangement is connected to the respective hull. More than one mount bracket may be provided for fixing to the respective hull.

At least one of the joints may be rotatable, about multiple axis such as a rod end or ball joint or about substantially one axis, such as a pin joint or stiff bushing. Alternatively, at least one of the joints may be flexible, such as a strip of material that flexes to act similar to a hinge but potentially with less torsional stiffness than a hinge. Alternatively, at least one of the joints may be resilient, such as a rubber bushing that can also provide some isolation, or a rotatable or flexible joint that incorporates resilience.

Preferably as many of the locating and support loads as possible pass directly into the frame, so the frame may include mounts or attachment points for more than at least one of the frame joints of each locating linkage. For example, the frame may include mounts or attachment points for at least two of the frame joints, or for at least three of the frame joints.

More than half of any static loads between the locating linkage arrangements and the hulls and/or between the supports and the hulls may be resolved within the frame. Indeed sixty percent, or seventy percent or preferably eighty percent or more preferably ninety percent of static loads between the locating linkage arrangements and the hulls and/or between the supports and the hulls may be resolved within the frame. The more of the movable first joints of the locating linkage arrangement and the support frame mounts that are directly connected to the frame, the less suspension forces that are then input direct to the body portion.

Alternatively, more than eighty-five percent of any static loads between the locating linkage arrangements and the hulls and between the supports and the hulls may be resolved within the frame. Preferably, ninety percent or more preferably ninety-five percent of static loads between the locating linkage arrangements and the hulls and between the supports and the hulls may be resolved within the frame.

The chassis module may further include respective support hull mounts for the respective at least one left support and at least one right support; and may further include at least one respective locating linkage hull mount for the at least one left locating linkage arrangement and the at least one right locating linkage arrangement. At least one of the left or right support hull mounts may be integral with at least one of the respective left or right locating linkage hull mounts.

The locating linkage arrangements and/or the supports may be assembled prior to fitment of the body and/or hulls. For example, the locating linkage arrangements and/or the supports may be assembled to the frame prior to supply of the chassis module to a boatbuilder for such fitment of the body and/or hulls. Similarly, any pneumatics and/or hydraulics (support rams, control manifold, tank, etc.) may be assembled prior to supply to a boat builder. Additionally, any hydraulic systems may be bled and/or charged prior to supply. Connectors for electrical or electronic components, such as human machine interface and any sensors required remote to the frame may be assembled prior to supply to a boatbuilder. Sensors that may be remote to the frame may include speed, steering, lateral g (especially if measured higher on body) or engine data.

At least one of the locating linkage hull mounts and/or at least one of the support hull mounts may be part of at least one upright or hull mount bracket fixed to the hull. In this case, the links of the locating linkage arrangements and/or the supports can be supplied separately for fitment by the boatbuilder, or conversely, the hulls may be supplied with the frame, locating linkage arrangements and supports.

The frame may include a forward portion, a rearward portion and a spine portion between the forward and rearward portions. An upper side of the spine portion may be at least partially open. This can allow access into the spine section, but the body may be required to provide increased torsional stiffness, although if holes perforate only part of the top or upper side of the spine portion, and the edges holes are flared or flanged, then the reduction in torsional stiffness of the frame due to the holes can be reduced. Alternatively, the spine may have an effectively closed section whereby any access holes are closed, in use, excluding holes for fluid conduit or electrical wiring connections (which are preferably sealed or bulkhead fittings or connectors used). For example, such access holes may be closed by removable blanking plates or covers that may be bolted or otherwise fixed in place, in use. Such blanking plates or covers can, when fixed in place, significantly reduce loss of torsional stiffness of the frame.

The spine may be used to house at least part of a power system at least part of one or more control systems. For example, the power systems may include batteries, supercapacitors and/or inverters. The control systems may, when the supports include hydraulic components, include at least one pump, tank, valve manifold, accumulators, fluid amplifier/displacer cylinders and the like.

An underside of the spine portion may be shaped such that at least a portion of longitudinal centreline of the underside is higher or preferably lower than regions of the underside on either side of the longitudinal centreline. For example, the underside of the spine portion may be bowed concave or preferably convex, or have a V-profile. If open to the water or spray below the body, water hitting the underside can generate noise, so thicker material and/or a non-flat lateral profile of at least a portion of the underside is preferred. The frame or at least the spine portion of the frame may be shaped like a hull. Alternatively, a front portion of the frame may be shaped like the bow of a hull to minimise the effects of water splashing onto or engaging with the frame.

The at least one left support may include a front left support and a back left support and the at least one right support may include a front right support and a back right support. The frame mounts for at least one left support and at least one right support may include respective frame mounts for the respective front left support, back left support, front right support and back right support. A respective hull mount may be provided for the respective front left support, back left support, front right support and back right support. The at least one left locating linkage arrangement may include a front left locating linkage arrangement and a back left locating linkage arrangement and the at least one right locating linkage arrangement may include a front right locating linkage arrangement and a back right locating linkage arrangement. The supports may act on the locating linkage arrangements, such as on a wishbone or other link. For example, the respective hull mount for the respective front left support, back left support, front right support or back right support may be connected to, fixed to or integral with the respective locating linkage arrangement.

In use, the at least one left hull and the at least one right hull may be able to move or may be permitted to displace at least vertically with respect to the frame, i.e. in at least a heave or vertical direction oriented with respect to the frame. The displacement of the hulls with respect to the frame may be controlled by the supports. For example, the vertical displacement of the hulls with respect to the frame may be determined, at least in part, by the supports.

The at least one left support and the at least one right support may include a resilient element. The resilient element may be or include a coil spring, torsion bar, air spring (or air bag), gas pressure accumulator, compressible block (such as a rubber or urethane block of any shape to provide the desired resilient characteristics) or any other known resilient means.

The at least one left support and at least one right support may include at least one actuator. For example, the actuator may be a hydraulic actuator or an electro-magnetic linear actuator. Alternatively or additionally, the or an actuator may be in series with a resilient element to enable adjustment of the support. The actuator may be controlled actively (which is typically at a higher frequency than the natural frequency of the mode being controlled), semi-actively (which is typically lower than the natural frequency of the mode being controlled) or passively (which can be achieved using interconnections).

The chassis module may further include at least one support interconnection, the or each support interconnection providing communication between at least two of said at least one left and at least one right supports. The communication may be direct, for example to remove or reduce a pitch or roll stiffness. Alternatively, the interconnection may be indirect, for example if the interconnection includes a displacer which can be actuated to drive a relative displacement of the interconnected supports.

The at least one left support and the at least one right support may include at least one damping element. The damping element may be a fluid flow control type such as a liquid flow controlled by an orifice, valving or electro or magnetic fields, or gas compression with flow control between two chambers to provide frequency dependent damping, or electro-magnetic power generation or dissipation type.

The at least one left hull may be one (i.e. a single) left hull and the at least one right hull may be one (i.e. a single) right hull, the at least one left locating linkage arrangement and the at least one right locating linkage arrangement arranged to permit individual heave and pitch displacement of the individual left and right hulls with respect to the frame while constraining individual roll, yaw, lateral and longitudinal displacements of the hulls with respect to the frame. The body may be fixed to the frame at the mounts or attachment points such that in use, when at a normal ride height and when stationary on calm water, the body does not engage with the water. This configuration is typically referred to as a catamaran type configuration. Alternatively, the body may be fixed to the frame at the mounts or attachment points such that in use, when at a normal ride height and when stationary on calm water, the body is engaged with the water. In this case, the body engaging with the water can provide both a hull function and a deck or cabin function like a monohull vessel, so this configuration is typically referred to a trimaran configuration, or a fixed centre hull trimaran configuration, especially when the side (left and right) hulls are movable relative to the frame (and body).

Alternatively, in use, the at least one left hull may be a front left hull and a back left hull and the at least one right hull may be a front right hull and a back right hull, the at least one left locating linkage arrangement including a front left locating linkage arrangement for the front left hull and a back left locating linkage arrangement for the back left hull; and the at least one right locating linkage arrangement including a front right locating linkage arrangement for the front right hull and a back right locating linkage arrangement for the back right hull, each respective locating linkage arrangement being arranged to permit at least heave displacement of the front left, back left, front right or back right hull with respect to the frame while constraining individual roll, yaw, lateral and longitudinal displacements with respect to the frame. Pitch motions or displacements with respect to the frame of at least the front left and front right hulls may be individually permitted. Alternatively or additionally, pitch motions or displacements with respect to the frame of at least the back left and back right hulls may be constrained, for example by using a geometry which controls pitch attitude in dependence on heave position.

The at least one left or right locating linkage arrangement may include two arms being a sliding or variable length arm longitudinally spaced from a leading or trailing arm. The variable length arm provides a pitch freedom for the relevant hull with respect to the frame. Such hull locating arrangements are disclosed in the applicant's U.S. Pat. No. 9,272,753, details of which are incorporated herein by reference.

Alternatively, the at least one left or right locating linkage arrangement may include two arms being a first leading or trailing arm and a second leading or trailing arm. If only the two arms are used and both arms are fixed length, then together with the body and respective hull, this arrangement effectively forms a quadrilateral in side view, so constrains the pitch of the hull, i.e. it has no pitch freedom, although its pitch angle may be driven to change in dependence on the vertical travel of the hull relative to the body. To avoid this hull pitch constraint, the first leading or trailing arm may be pivotally connected to the respective hull at a first end and pivotally connected to the frame at a second end; and the second leading or trailing arm may, at a first end, be pivotally connected to a second end of a drop link forming a knee member, the knee member being connected between the frame and the respective hull by a pivot at a second end of the second leading or trailing arm and a pivot at a first end of the drop link.

Alternatively, the at least one left or right locating linkage arrangement may include at least one respective wishbone. The at least one respective wishbone may comprise a respective upper wishbone and a respective lower wishbone. Using at least one wishbone extending at least laterally of the frame can limit the pitch of the hull of a catamaran where front and rear wishbones effectively both provide a longitudinal constraint, so if wishbones are used on a catamaran, an additional longitudinal degree of freedom needs to be provided, such as by a longitudinal slider on the hull mount.

Alternatively, the at least one left or right locating linkage arrangement may each include a respective first link, a respective second link, a respective third link and a respective fourth link; the first, second and third links extending in at least a lateral direction, the first link being disposed longitudinally of at least one of the second and third links; the fourth link extending in at least a longitudinal direction. Such hull locating arrangements are disclosed in the applicant's U.S. Pat. No. 10,556,650, details of which are incorporated herein by reference.

Each of the first, second, third and fourth links may be rotatably, flexibly, or resiliently connected at a first end to the frame and at a second end to the respective hull. Alternatively, each of the first, second and third links may be rotatably, flexibly or resiliently connected at a first end to the frame and at a second end to the respective hull, and the fourth link may be rigidly fixed at a first end to the first, second or third link and is rotatably, flexibly, or resiliently connected at a second end to the frame or to the respective hull. Alternatively, each of the first, second and third links may be rotatably, flexibly or resiliently connected at a first end to the frame and at a second end to the respective hull, and the fourth link may be rigidly fixed or rotatably, flexibly or resiliently connected at a first end to the first, second or third link and is arranged for rotatable, flexible, or resilient connection at a second end to the body for the vessel, in use. Alternatively, at least one of the first, second or third links may be rotatably, flexibly, or resiliently connected at a first end to the frame and at a second end to the respective hull and at least the fourth link may be arranged for rotatable, flexible, or resilient connection at a first end to the body for the vessel, in use, and at a second end to the respective hull. For example, at least the fourth link is connected between the body and the hull. Alternatively, at least one of the first, second, third and fourth links may be rotatably, flexibly, or resiliently connected at a first end to the frame and at a second end to the respective hull, the remaining (or other) of the first, second, third and fourth links being arranged for rotatable, flexible, or resilient connection at a first end to the body for the vessel, in use, and at a second end to the respective hull. For example, at least one of the 4 links is between frame and hull, the other link(s) being between body and hull.

A lateral distance between a hull joint of a left locating linkage arrangement and a hull joint of a right locating linkage arrangement may be a track, and the frame may have a length and a width. The width of the frame may be less than half of the track for at least half of the length of the frame. Alternatively, the width of the frame may be less than two thirds of the track for at least one third of the length of the frame.

The frame may have a length and may include a central tunnel or spine portion having a tunnel length and a tunnel height. The tunnel length may be at least one quarter, or at least one third, or at least half or preferably at least two thirds or more preferably at least three quarters of the length of the frame. Additionally or alternatively, the tunnel height may be less than one tenth of the length of the frame, preferably less than one fifteenth and more preferably less than one twentieth of the length of the frame.

In accordance with a second aspect of the present invention, there is provided a method of constructing a vessel comprising a body portion, at least one left hull and at least one right hull, wherein the vessel includes a chassis module comprising a frame, at least one left locating linkage arrangement for the at least one left hull and at least one right locating linkage arrangement for the at least one right hull; each locating linkage arrangement including at least one member and having at least one frame joint at or near or toward a first end and having at least one hull joint at or near or toward a second end; the frame including mounts or attachment points for the frame joints of each locating linkage arrangement and frame mounts for at least one left support and at least one right support; and the frame including mounts or attachment points for the body portion; the method including the step of: assembling the frame and locating linkage arrangements of the chassis module.

Additionally, the step of assembling the frame and locating linkage arrangements of the chassis module may further include the step of assembling the or one of the at least one left support and the of one of the at least one right support.

Additionally or alternatively, the step of assembling the frame and locating linkage arrangements of the chassis module may further include the step of assembling at least one interconnection between the at least one left support and the at least one right support.

Additionally or alternatively, the step of assembling the frame and locating linkage arrangements of the chassis module further includes the step of assembling a control arrangement for the at least one left support and the at least one right support.

Additionally or alternatively, the method may further include the step of assembling the or one of the at least one left support and the of one of the at least one right support.

Additionally or alternatively, the method may further include the steps of assembling the body portion to the frame; assembling the at least one left hull to the at least one left locating linkage arrangement and assembling the at least one right hull to the at least one right locating linkage arrangement.

DESCRIPTION OF PREFERRED EMBODIMENT

Figure 1:
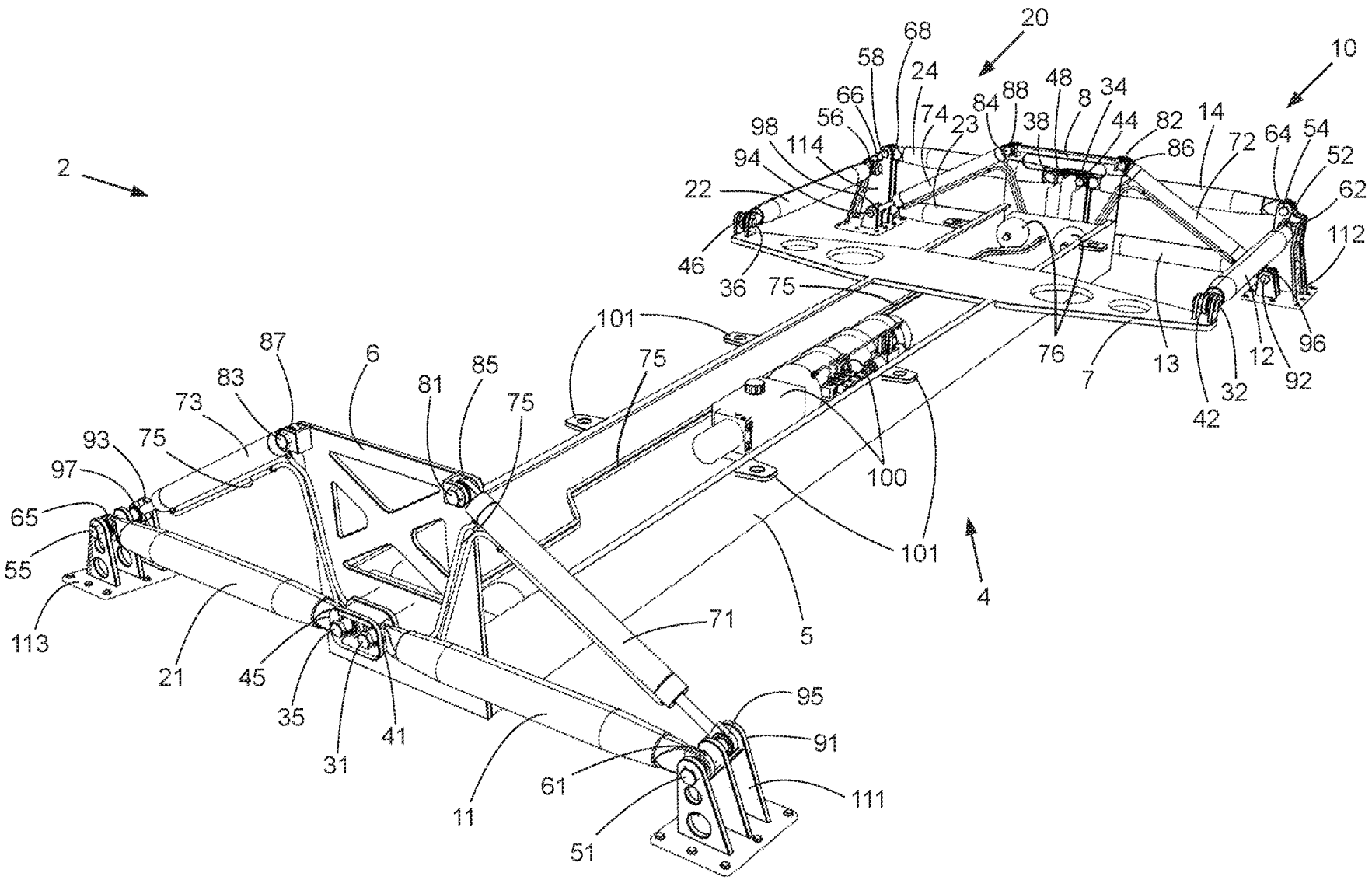
FIG. 1 is an angled view of a chassis module according to the present invention.

In the following description of examples of embodiments of the invention, common reference numerals are used for equivalent components or features.

Referring initially to FIG. 1 there is shown a chassis module 2. The chassis module comprises a frame 4, at least one left locating linkage arrangement 10 and at least one right locating linkage arrangement 20. Each locating linkage arrangement comprises, in this example a forward lateral link 11, 21, a rearward longitudinal link 12, 22, a rearward lower lateral link 13, 23, and a rearward upper lateral link 14, 24. Although the various links 11, 12, 13, 14, 21, 22, 23, 24 are designated lateral or longitudinal, it should be understood that they preferably primarily extend in at least the respective lateral or longitudinal direction with respect to the frame and may additionally be individually angled up or down, or side to side.

The frame 4 has a longitudinal tunnel or spine portion 5 which connects the forward portion 6 (or front mount member or structure) to the rearward portion 8 (or rear mount member or structure). In this example, a lateral beam 7 is provided. The lateral links 11, 13, 14 and 21, 23, 24 are connected to respective locating linkage frame mounts, only some of which 31, 34 and 35, 38 are visible, at joints, only some of which 41, 44 and 45, 48 are visible and to respective locating linkage hull mounts, only some of which 51, 54 and 55, 58 are visible at joints, only some of which 61, 64 and 65, 68 are visible. The longitudinal links 12, 22 are connected to respective locating linkage frame mounts 32, 36 at joints 42, 46 at respective ends of the lateral beam 7 and to respective locating linkage hull mounts 52, 56 at joints 62, 66.

Front left, back left, front right and back right supports 71, 72, 73, 74 are connected between respective support frame mounts 81, 82, 83, 84 at joints 85, 86, 87, 88 and respective support hull mounts 91, 92, 93, 94 at joints 95, 96, 97, 98. Each of the joints facilitates at least rotational movement about one axis of the relevant support 71, 72, 73, 74.

In this example, the supports are hydraulic cylinders, so fluid conduits 75 such as tubes and hoses are shown. Also disposed in the spine portion 5 are components of a control arrangement 100, which for the hydraulic supports shown can be a motor, pump, tank, valve manifold and optionally a fluid amplifier or displacer cylinder arrangement. Resilience in the form of fluid pressure accumulators 76 for each hydraulic support can also be located in the tunnel or spine portion 5. On the spine portion are body mounts 101 to which the body (not shown) can be mounted in use. Additional body mounts can be provided on the lateral beam 7, on the forward portion 6 of the frame and/or the rearward portion 8 of the frame.

The respective locating linkage hull mounts of the front left, back left, front right, back right lateral links and the left and right longitudinal links, and the respective support hull mounts 91, 92, 93, 94 of the front left, back left, front right and back right supports 71, 72, 73, 74 can be part of the respective hull mount brackets 111, 112, 113, 114 or uprights. For example, in the present embodiment, the front left locating linkage hull mount 51 and the front left support hull mount 91 are part of the front left hull mount bracket 111. The back left locating linkage hull mounts, only two of which 52, 54 are visible, and the back left support hull mount 92 are part of the back left hull mount bracket 112. Similarly, the locating linkage hull mount 55 and the front right support hull mount 93 are part of the front right hull mount bracket 113. The back right locating linkage hull mounts, only two of which 56, 58 are visible, and the back right support hull mount 94 are part of the back left hull mount bracket 114.

The spine portion 5 is open to the top or on the upper side in the example in FIG. 1. This enables easy access to any components that are located within the spine, but does reduce the torsional stiffness of the frame when compared to a closed top spine. Access hatches can be placed in the floor of a body when it is mounted to the body mounts 101.

The chassis module 2 can be assembled as shown, including the links 11, 12, 13, 14, 21, 22, 23, 24, the hull mount brackets 111, 112, 113, 114, the supports 71, 72, 73, 74, any support interconnections such as the fluid conduits 75, any additional resilience such as the fluid pressure accumulators 76 and some or all of any support control arrangement 100. Such a chassis module may then only require the hulls and body to be connected to the chassis module 2, for example by a boat builder who would provide all the usual trim and fit-out appropriate.

The chassis module 2 can include some or all of the sensors required for any desired automatic operation. For example, with a hydraulic support arrangement such as that shown with the control arrangement 100, a controller can be provided to implement functions such as ride height control, height and level maintenance and any active functions such as rolling the body into a turn as described in the applicant's U.S. Pat. No. 10,286,980, details of which are incorporated herein by reference. Electrical connections can be provided to enable sensors or other devices such as human machine interface units to be provided on the body and hulls and connected into the chassis module.

As the mass, weight distribution and buoyancy of the hulls and the body can vary with different hulls and body styles and fit-outs, when the vessel is completed with hulls and a body fitted, the controller may, for example, detect the attitude of the body and/or hulls, the displacement of the front and back, left and right supports, the pressure in and/or load on the supports and other data relating to operational characteristics to automatically fine-tune or calibrate the controller. Alternatively, or additionally, the controller may communicate with a set-up or diagnostic device or transmit such data remotely to enable settings in the controller to be fine-tuned to the characteristics of the completed vessel.

Figure 2:
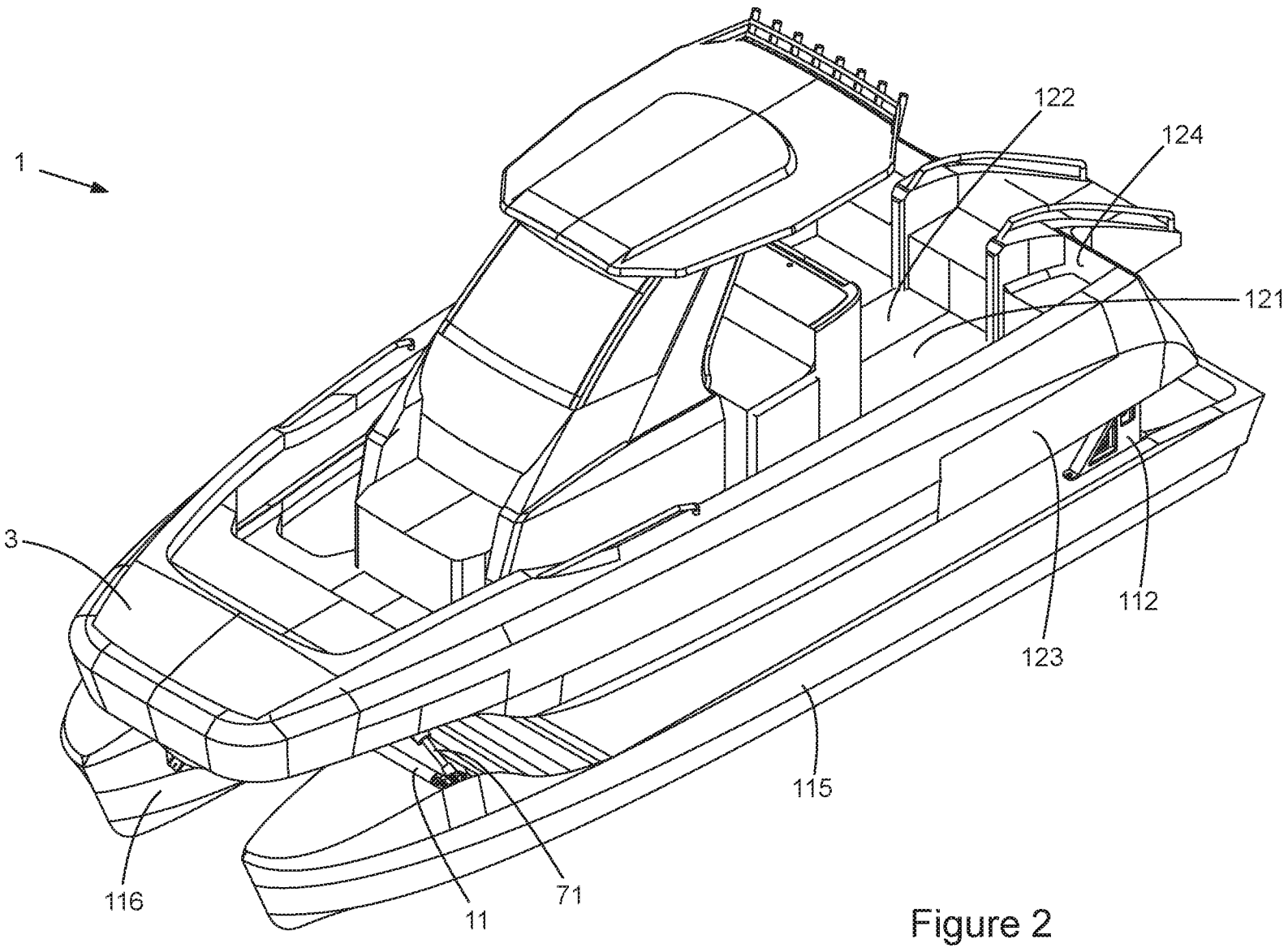
FIG. 2 is an angled view of a vessel including a body, a left hull, a right hull connected to a chassis module similar to FIG. 1.

FIG. 2 shows a vessel 1 having a body portion 3 supported or at least partially suspended above a left hull 115 and a right hull 116. The type of body and the type of hull can be varied considerably to enable a common chassis module to be used with any hull and body styles as desired. For example, a boat manufacturer may wish to provide different hull styles and body styles to suit specific uses and markets. However due to the additional complexity of providing a multi-hull boat with suspension compared to a conventional monohull or fixed hull catamaran, it would be beneficial to enable a common platform or chassis module to be applied to a range of products. This allows the cost of development of the chassis arrangement to be amortised over a range of products and also allows the number of parts required to be kept to a minimum across a whole range of vessels with movable hulls.

The body portion 3 and hulls 115, 116 shown in FIG. 2 are fora sports recreation vessel. However, the body portion 3 can be any form, including a rigid inflatable boat style body, a speed boat style body, a pontoon boat style body, a water taxi style body and a walk-around or centre-console style body. Similarly, the hull forms 115, 116 can be varied to suit particular applications.

One or more access panels 122 can be provided in the deck 121 of the body 3 to provide access into the spine portion of the chassis module. To the side of the deck 121 are shown typical gunwales 123 and to the rear a similar structure or transom 124.

Figure 3:
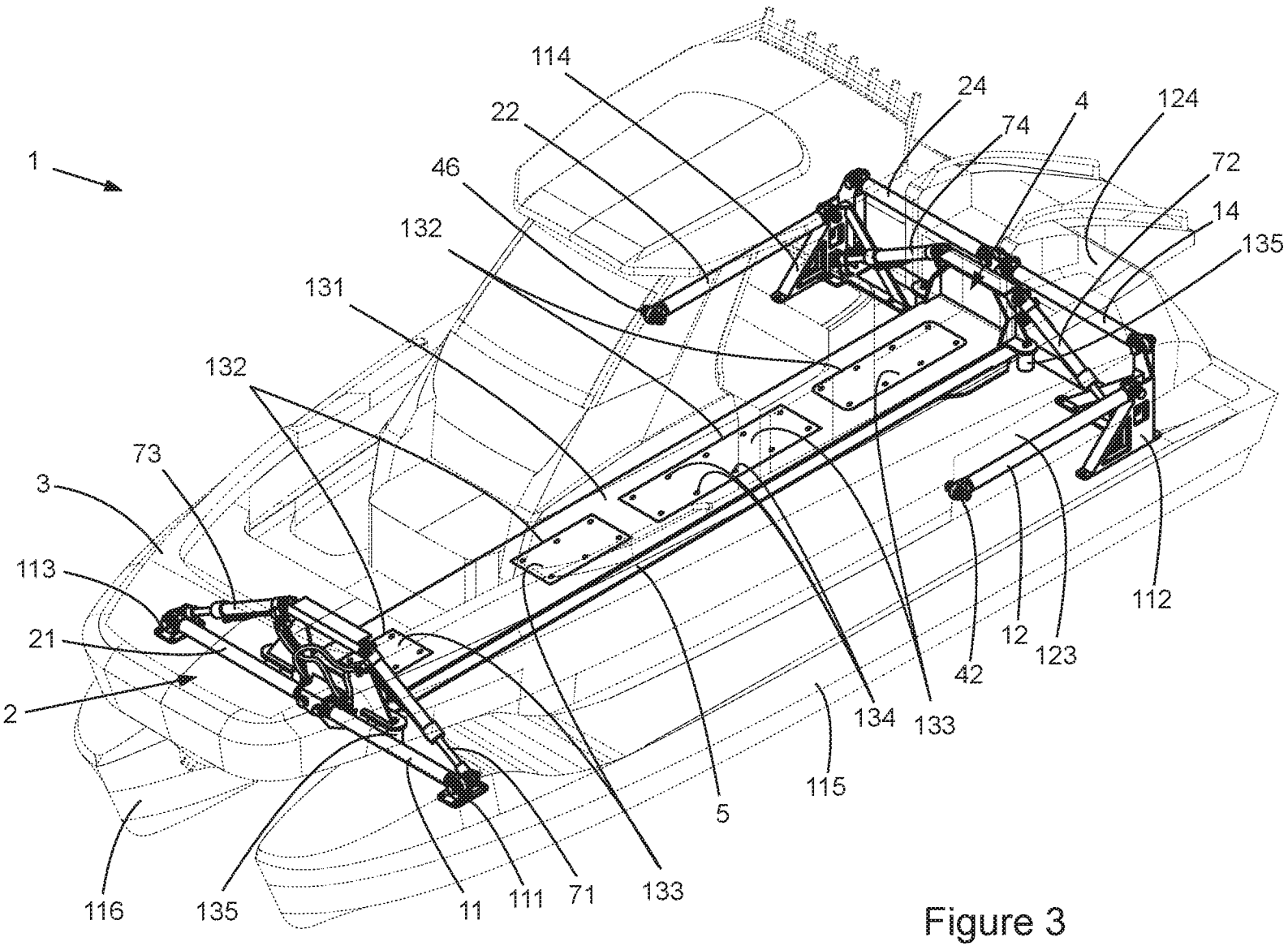
FIG. 3 is a partially transparent view of the vessel of FIG. 2 with the body and hulls transparent to show the chassis module.

In FIG. 2 only the front left support 71, front left lateral link 11 and back left hull mount bracket 112 of the chassis module are visible. FIG. 3 shows the body portion 3 and hulls 115, 116 in dashed lines so that the chassis module 2 is visible. The chassis module 2 in FIG. 3 is similar to, but includes a few modifications from, the chassis module in FIG. 1. The frame 4 has a closed spine portion 5, but includes access holes 132 in the upper side 131 of the spine portion 5. The access holes 132 are covered by removable blanking plates 133 which are held in place by fixings 134. The blanking plates preferably seal so that the inside of the spine portion 5 is watertight and any components therein are protected. The access holes 132 can be accessed from the deck by access panels in the deck, for example as shown in FIG. 2. The frame also includes bump stops 135 for progressively resiliently limiting travel of the respective hull 115, 116 upwards relative to the frame 4.

The hulls 115, 116 are shown connected to the chassis module 2. The front left hull mount bracket 111 is fixed to the front of the left hull 115 and the back left hull mount bracket 112 is fixed to the back of the left hull 115. Similarly, the front right hull mount bracket 113 is fixed to the front of the right hull 116 and the back right hull mount bracket 114 is fixed to the back of the right hull 116.

Unlike the frame joints 42, 46 of longitudinal links 12 and 22 of the embodiment shown in FIG. 1, the joints of the longitudinal links of the embodiment in FIG. 3 are not connected directly to the frame as the frame does not include a lateral beam 7. Instead, the longitudinal links 12 and 22 are intended to be connected directly to the body portion 3, which is in turn connected to the frame. As the loads in the longitudinal links are largely in the longitudinal direction and are very low when the vessel is not moving, the body portion can typically be designed to provide sufficient strength as the longitudinal link is located under and/or inside the gunwales 123 of the body portion 3.

As can be seen from the relative position of the longitudinal links 12, 22, the back upper lateral links 14, 24 and the back hull mount brackets 112, 114, they are all located or packaged under and/or at least partially inside the gunwales 132 and transom 124. Therefore, as the suspension compresses and the back supports 72, 74 contract, the aforementioned links and brackets move further into cavities provided in the gunwales and transom. This packaging allows the deck to be lower than it would need to be if had to clear all the links through the entire travel of the suspension of the chassis module. It also allows the links to be at least partially hidden from view and protected or guarded from unintentional contact.

Figure 4:
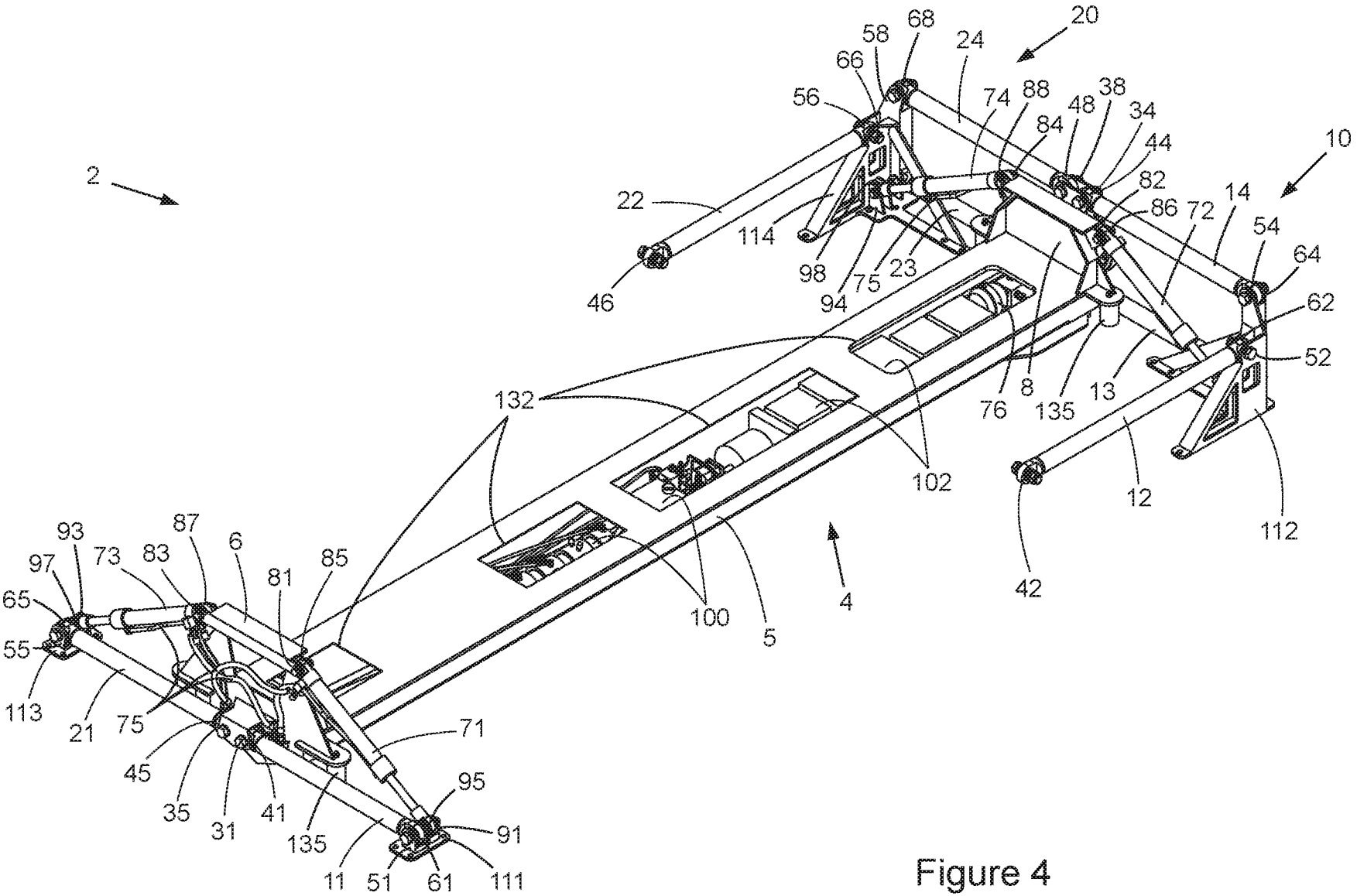
FIG. 4 is angled view of the chassis module of FIG. 3.

The chassis module of FIG. 3 is shown in isolation in FIG. 4 for clarity. The access holes 132 in the upper side of the spine portion 5 are not covered. If blanking plates are not used, the loss of torsional strength of the spine portion due to the access holes can be reduced by flaring the edges, for example to form a flange running around the periphery of the hole. Inside the spine portion 5 are fluid pressure accumulators, components of a control arrangement such as motor, pump, tank and fluid displacer cylinder. Also shown are components 102 of a power system, being batteries in this example, but could include super capacitors, inverters and other power components. The volume and confinement of the inside of the spine can be beneficial to house a variety of components, keeping the weight low in the sprung mass, below much of the body portion.

The underside of the frame is not clearly visible in FIG. 4, but at least the spine portion is preferably shaped to reduce drag and noise should it come into contact with the water. For example, an underside of the spine portion may be shaped such that at least a portion of longitudinal centreline of the underside is a different height to regions of the underside on either side of the longitudinal centreline. Typically, the underside of the spine portion may be bowed concave or preferably convex, or more preferably have a V-profile, at least in part. If open to the water or spray below the body, water hitting the underside can generate noise, so thicker material and/or a non-flat lateral profile of at least a portion of the underside is desirable. The frame or at least the spine portion of the frame may be shaped like a hull. Alternatively, a front portion of the frame may be shaped like the bow of a hull to minimise the effects of water splashing onto or engaging with the frame.

Figure 5:
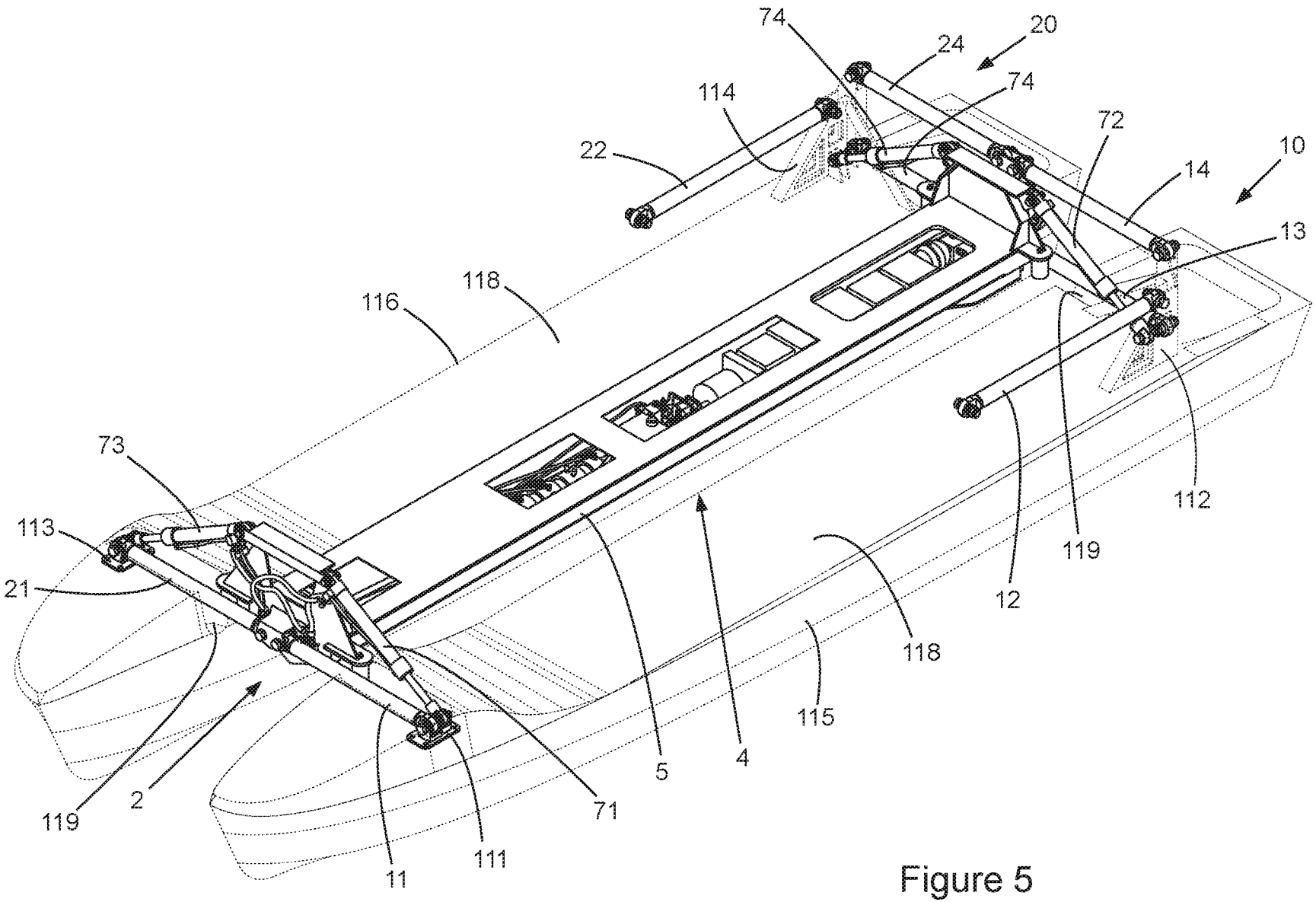
FIG. 5 is an angled view of a chassis module similar to the chassis module of FIGS. 3 and 4 with transparent hulls connected.

In FIG. 5, the hulls 115, 116 are shown in dashed lines, connected to the chassis module 2. However, the back left hull mount bracket 112 and the back right hull mount bracket 114 are fixed to, part of, or integral with the respective left or right hull 115, 116. Depending on the structure of the hull, it can be preferable to integrate the front and/or back hull mount brackets into the hull instead of the chassis module 2. As the hull joints of the locating linkage arrangement members (i.e. the lateral and longitudinal links 11, 12, 13, 14, 21, 22, 23, 24) and the supports 71, 72, 73, 74 may not have hull mounts present when the module is initially assembled prior to supply to a boat builder, the locating linkage arrangement members and the supports can be supplied in a knock down kit form ready for assembly. This can make the chassis module easier to package for shipment as it can be narrower. If the supports 71, 72, 73, 74 are hydraulic as shown, they can be connected to the fluid conduits 75 and bled when the module is initially assembled, then strapped or otherwise placed on the frame for connection by the boat builder. This can also reduce the need for clean room facilities after the chassis module is initially manufactured as well as allowing for additional quality checks prior to shipment of the chassis module.

In FIG. 5 lateral channels 119 in the tops of the hulls 115, 116 can be seen and are provided to permit the front lateral links 11, 21 and the back lower lateral links 13, 23 to be located close to or even below the upper surfaces 118 of the hulls.

Figure 6:
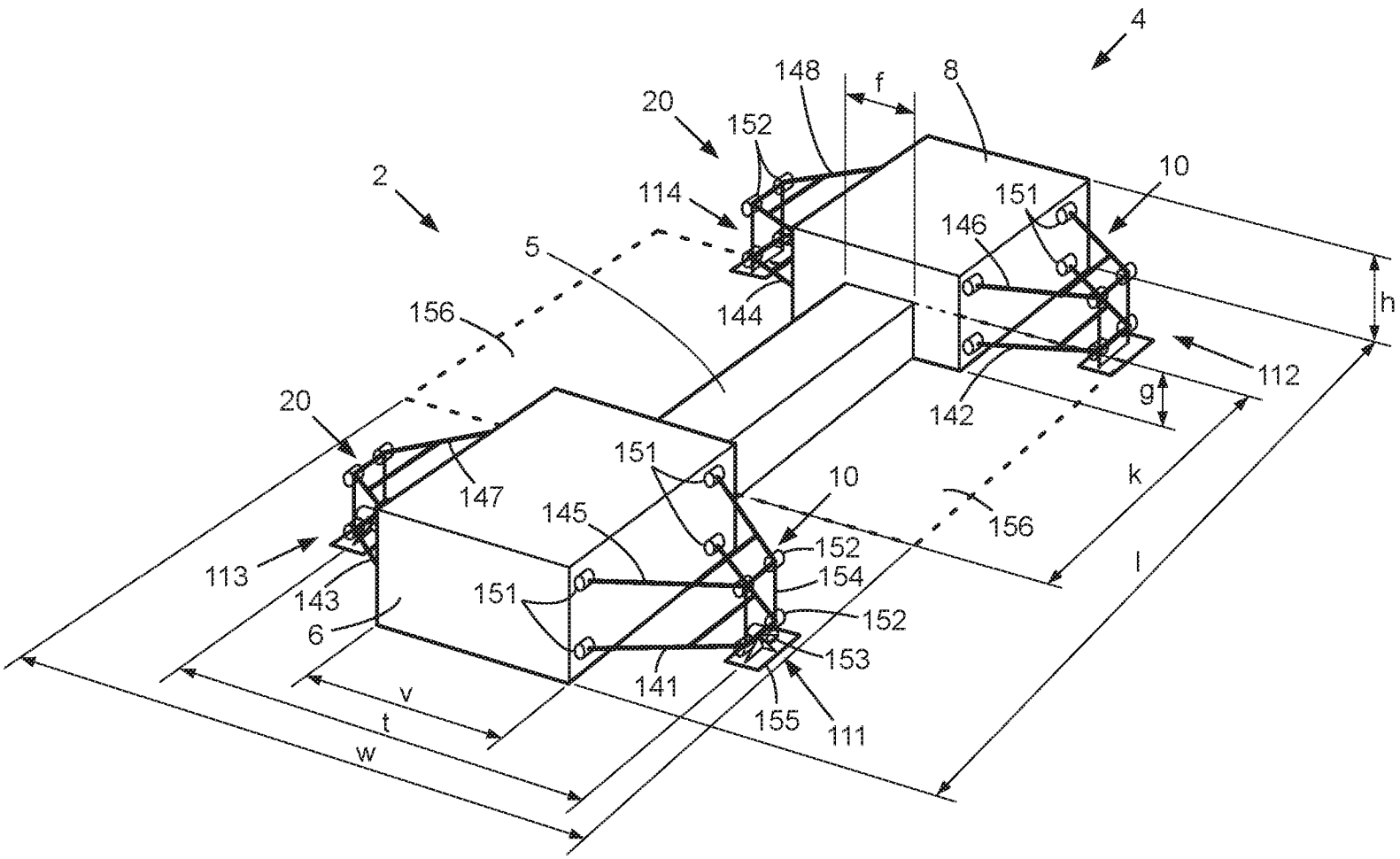
FIG. 6 is an angled view of another chassis module according to the present invention.

FIG. 6 shows an alternative chassis module. In this example, the left and right locating linkage arrangements 10, 20 are respective front and rear pairs of upper and lower wishbones 141 and 145; 142 and 146; 143 and 147; 144 and 148. The front and rear mount members are larger blocks to facilitate the anchoring of the wishbones mounts at frame joints 151 and the outer ends of the wishbones are connected by hull (or hull end) joints 152 to the respective hull mount bracket 111, 112, 113, 114. In this example, the front hull mount brackets 111, 113 include a hull pitch joint 153 between the upright portion 154 of the hull mount bracket and the hull mounting plate portion 155 of the hull mount bracket. This hull pitch joint 153 is provided to permit pitch of the hulls relative to the upright and ultimately relative to the frame. Resilience or control (not shown) can be provided for the pitch of the hulls relative to the uprights. While not essential, allowing at least a controlled amount of pitch of the front hulls relative the frame is desirable. The back hull mount brackets 112, 114 can optionally, similarly permit hull pitch, or as shown can be rigid to substantially prevent pitch of the back hulls relative to the frame.

The longitudinal tunnel or spine portion 5 is shown enclosed, although can be open topped as in FIG. 1, but sealable access holes as shown in FIG. 3 for access from within a body, in use, is preferred. The spine portion 5 has width f and height g. The front and rear mount members 6 and 8 are the tallest regions of the frame 4 in this example having height h and width v, although they may be different front to back. An optional body mounting plate 156 is shown in dashed lines as part of the frame and can be used as a body mounting. This can be beneficial in defining a level below which space is required for hull motions and for increasing rigidity of the final vessel once a body is connected to the frame 4.

The track width t is measured between the hull mounts of the left and right hulls. In this example although a lateral beam is not required to mount longitudinal links, the frame 4 can still have a wider portion of width w in the region of the spine portion 5, between the front and rear locating linkage arrangements 10, 20 and the associated front and rear mount members or structures 6, 8.

The width w of the frame of any of the chassis modules disclosed can be can be less than half of the track t. Alternatively, the width w of the frame of can be can be less than two thirds of the track t for at least one third of the length l of the frame. The width of the frame when the body mounting plate is omitted, as is preferred, is typically determined by the width v of the front and/or rear mount members 6, 8, which can be less than two thirds of the track t for at least two thirds of the length l of the frame.

The width f of the spine portion can be less than one third of the track t. The length of the spine portion k can be at least the distance between the front and rear mount members 6, 8, preferably at least eighty percent of the length l of the frame and more preferably at least ninety percent of the length l of the frame. The height g of at least half of the length k of the spine portion 5 is preferably less than one tenth of the length l of the frame, more preferably less than one fifteenth and yet more preferably less than one twentieth of the length of the frame.

The invention claimed is:

1. A chassis module for a vessel, the chassis module comprising:

a frame;

at least one left locating linkage arrangement for connection to at least one left hull; and at least one right locating linkage arrangement for connection to at least one right hull;

each locating linkage arrangement permitting at least heave motions of the respective hull relative to the frame and constraining the respective hull in at least lateral, longitudinal, roll and yaw directions relative to the frame, when the respective hull is connected to the respective locating linkage arrangement;

each locating linkage arrangement including at least one member, each member having at least one respective movable first joint adjacent a first end and having at least one respective movable second joint adjacent a second end, each movable second joint being connected to the respective hull when the respective hull is connected to the respective locating linkage arrangement;

the frame including respective attachment points for at least one of the movable first joints of each locating linkage arrangement;

the frame including respective support frame mounts for at least one left support and at least one right support;

the frame including attachment points of a body of the vessel;

the frame including a forward portion, a rearward portion, and a spine portion between the forward and rearward portions;

wherein solely the spine portion connects the forward portion and the rearward portion;

wherein the frame is configured such that more than half of any static loads between the locating linkage arrangements and the hulls or between the supports and the hulls, are resolved within the frame;

wherein a lateral distance between a hull joint of a left locating linkage arrangement and a hull joint of a right locating linkage arrangement is a track width, the frame having a frame length, the spine portion defining spine dimensions comprising a spine length, a spine height, and a spine width;

wherein the spine dimensions include at least one of the following: the spine length being at least one quarter of the length of the frame; the spine height being less than one tenth of the length of the frame; and the spine width being less than one third of the track width; and wherein the spine is configured to house at least part of at least one of a power system, a control system of the chassis module, and components of the chassis module.

2. The chassis module of claim 1 wherein more than eighty-five percent of any static loads between the locating linkage arrangements and the hulls and between the supports and the hulls, are resolved within the frame.

3. The chassis module of claim 1 further comprising:

respective support hull mounts for the respective at least one left support and at least one right support; and at least one respective locating linkage hull mount for the at least one left locating linkage arrangement and the at least one right locating linkage arrangement.

4. The chassis module of claim 1 wherein an upper side of the spine portion is at least partially open.

5. The chassis module of claim 1 wherein the spine has an effectively closed section whereby any access holes are closed in use, excluding holes for fluid conduit or electrical wiring connections.

6. The chassis module of claim 1 wherein the at least one left support includes a front left support and a back left support and wherein the at least one right support includes a front right support and a back right support.

7. The chassis module of claim 1 wherein the at least one left support and the at least one right support includes a resilient element.

8. The chassis module of claim 1 wherein the at least one left support and at least one right support includes at least one actuator.

9. The chassis module of claim 1 further comprising at least one support interconnection, each interconnection providing communication between at least two of said at least one left and at least one right supports.

10. The chassis module of claim 1 wherein, in use, the at least one left hull comprises a single left hull and the at least one right hull comprises a single right hull, the at least one left locating linkage arrangement and the at least one right locating linkage arrangement arranged to permit individual heave and pitch displacement of the single left hull and the single right hull with respect to the frame while constraining individual roll, yaw, lateral and longitudinal displacements of the single left hull and the single right hull with respect to the frame.

11. The chassis module of claim 1 wherein, in use, the at least one left hull is a front left hull and a back left hull and the at least one right hull is a front right hull and a back right hull, the at least one left locating linkage arrangement including a front left locating linkage arrangement for the front left hull and a back left locating linkage arrangement for the back left hull, and the at least one right locating linkage arrangement including a front right locating linkage arrangement for the front right hull and a back right locating linkage arrangement for the back right hull, each respective locating linkage arrangement being arranged to permit at least heave displacement of the front left, back left, front right or back right hull with respect to the frame while constraining individual roll, yaw, lateral and longitudinal displacements with respect to the frame.

12. The chassis module of claim 1 wherein at least one of the at least one left locating linkage arrangement and the at least one right locating linkage arrangement comprises at least one respective wishbone.

13. The chassis module of claim 1 wherein each of the at least one left locating linkage arrangement and the at least one right locating linkage arrangement comprises a respective first link, a respective second link, a respective third link and a respective fourth link; wherein the first, second and third links extends in at least a lateral direction, the first link being disposed longitudinally of at least one of the second and third links; and wherein the fourth link extends in at least a longitudinal direction.

14. The chassis module of claim 13 wherein each of the first, second, third and fourth links is rotatably, flexibly, or resiliently connected at a first end to the frame and at a second end to the respective hull.

15. The chassis module of claim 13 wherein at least one of the first, second, third and fourth links is rotatably, flexibly, or resiliently connected at a first end to the frame and at a second end to the respective hull, the remaining of the first, second, third and fourth links being arranged for rotatable, flexible, or resilient connection at a first end to the body for the vessel, in use, and at a second end to the respective hull.

16. The chassis module of claim 1 wherein the frame has a width, the width of the frame being less than half of the track for at least half of the length of the frame.

17. The chassis module of claim 1 wherein the frame has a width, the width of the frame being less than two thirds of the track for at least one third of the length of the frame.

18. The chassis module of claim 1 wherein the spine length is at least one third of the length of the frame and/or the spine height less than one fifteenth of the length of the frame.

19. A method of constructing a vessel comprising a body portion, at least one left hull, at least one right hull, and a chassis module comprising a frame, at least one left locating linkage arrangement for connection to the at least one left hull and at least one right locating linkage arrangement for connection to the at least one right hull, each locating linkage arrangement permitting at least heave motions of the respective hull relative to the frame and constraining the respective hull in at least lateral, longitudinal, roll and yaw directions relative to the frame, when the respective hull is connected to the respective locating linkage arrangement, each locating linkage arrangement including at least one member, each member having at least one respective movable first joint adjacent a first end and having at least one respective movable second joint adjacent a second end, each movable second joint being connected to the respective hull when the respective hull is connected to the respective locating linkage arrangement, the frame including respective attachment points for at least one of the movable first joints of each locating linkage arrangement, the frame including respective support frame mounts for at least one left support and at least one right support, the frame including attachment points of a body of the vessel;

the frame including a forward portion, a rearward portion, and a spine portion between the forward and rearward portions;

wherein solely the spine portion connects the forward portion and the rearward portion;

wherein the frame is configured such that more than half of any static loads between the locating linkage arrangements and the hulls or between the supports and the hulls, are resolved within the frame;

wherein a lateral distance between a hull joint of a left locating linkage arrangement and a hull joint of a right locating linkage arrangement is a track width, the frame having a length, the spine portion defining spine dimensions comprising a spine length, a spine height, and a spine width;

wherein the spine dimensions include at least one of the following: the spine length being at least one quarter of the length of the frame; the spine height being less than one tenth of the length of the frame; and the spine width being less than one third of the track width; and the spine housing at least part of at least one of a power system, a control system of the chassis module, and components of the chassis module, the method comprising:

assembling the frame and locating linkage arrangements of the chassis module.

20. The method of claim 19 wherein the assembling of the frame and the locating of the linkage arrangements of the chassis module comprises assembling a control arrangement for the at least one left support and the at least one right support.

21. The method of claim 19 further comprising assembling one of the at least one left support and one of the at least one right support.

22. The method of claim 19 further comprising:

assembling the body portion to the frame;

assembling the at least one left hull to the at least one left locating linkage arrangement; and assembling the at least one right hull to the at least one right locating linkage arrangement.

* * * * *